US006074545A

United States Patent [19]

Ginatta

[11] Patent Number: 6,074,545

[45] Date of Patent: Jun. 13, 2000

[54] PROCESS FOR THE ELECTROLYTIC PRODUCTION OF METALS

[75] Inventor: Marco Vincenzo Ginatta, Turin, Italy

[73] Assignee: Cathingots limited, Liechtenstein

[21] Appl. No.: 09/018,539

[22] Filed: Feb. 4, 1998

Related U.S. Application Data

[63] Continuation of application No. PCT/IB98/00019, Jan. 8, 1998.

[30] Foreign Application Priority Data

Feb. 4, 1997 [IT] Italy ..... TO97A0080

[51] Int. Cl.[7] ..... C25C 3/36

[52] U.S. Cl. ..... 205/363; 205/367; 205/370; 205/371; 205/372; 205/398; 205/402; 205/406

[58] Field of Search ..... 205/363, 366, 205/368, 367, 375, 389, 391, 398, 401, 402, 404; 204/354, 243.1, 247.4, 241, 406

[56] References Cited

U.S. PATENT DOCUMENTS

| | | | |
|---|---|---|---|
| 3,030,285 | 4/1962 | Sarla | 204/64 |
| 3,087,873 | 4/1963 | Slatin | 204/71 |
| 3,383,294 | 5/1968 | Wood | 204/64 |
| 3,909,375 | 9/1975 | Holliday et al. | 204/64 R |
| 4,699,704 | 10/1987 | Ishizuka | 204/243 R |
| 5,242,563 | 9/1993 | Stern et al. | 204/241 |

FOREIGN PATENT DOCUMENTS

| | | |
|---|---|---|
| 786460 | 11/1957 | United Kingdom . |
| 1190679 | 5/1970 | United Kingdom . |

*Primary Examiner*—Bruce F. Bell
*Assistant Examiner*—Wesley A. Nicolas
*Attorney, Agent, or Firm*—Ostrolenk, Faber, Gerb & Soffen, LLP

[57] ABSTRACT

A Process for the electrolytic production of metals particularly titanium and alloys starting from the corresponding compounds is disclosed, by means of an apparatus for the electrochemical extraction including: (1) a cathode-crucible containing a mass of solidified metal, a liquid electrolyte with a density which is lower than that of the metal and a pool of liquid metal produced; (2) one or more non-consumable anodes particularly immersed in the electrolyte with means for regulating their distance from the cathodic surface; (3) a feeding system to the electrolyte of the compounds of the metals, of the electrolyte constituents and of alloying materials; (4) a power supply which feeds direct current to the liquid metal, and through the electrolyte, to the anodes, and causes the cathodic reduction of the metal in liquid form and the evolution of anodic gas, with the heat generation which maintains the electrolyte in the molten state; and (5) an air-tight containment structure in which the anodic gases generated during the electrolysis are collected.

24 Claims, 9 Drawing Sheets

PROCESS FOR THE ELECTROLYTIC PRODUCTION OF METALS

CROSS-REFERENCE TO RELATED APPLICATIONS

This is a continuation of International Application PCT/IB98/00019, with an International filing date of Jan. 8, 1998 and Italian Patent Application No. T097 A 000080 filed Feb. 4, 1997.

1) PREAMBLE

In order to improve an industrial electrolytic process, we need to take decisions which involve changes in physical operating conditions.

We need therefore, to reach a practical understanding of the physical meaning of the data which describe the operative conditions of the process.

The first reason for the technological lag in the development of the electrolytic process for producing Ti is the insufficient theoretical understanding of the Ti system.

The second reason is that we cannot draw information from the knowledge of the electrolytic process for producing Al since its theoretical formulation is far from a common acceptance.

This state of the matter is the consequence of the insufficient fundamental electrochemistry work; the formalisms used in the published literature on the subject are often devoid of a rational base and of a physical significance.

In fact, when the metallurgists attempts to interpret the phenomena occurring at a working single electrode, and this is exactly what he is interested in, he gets entangled in matters of principles about the thermodynamics of electrically charged species.

This state of the science is especially pitiful when we remember how much the electrochemistry has contributed to the development of thermodynamics.

By reading the published literature, we can see that the electrochemists still have fear to enter deep into the matter, that is to abandon the reversible equilibrium conditions, in which the metallurgists have no interest, and to abandon the two-dimensional interface unrealistic model.

The work which is illustrated herebelow is an attempt towards getting some understandable information of practical usefulness about the processes occurring at a single electrode, under steady state dynamic regimes, at the microscopical level, away from reversible equilibrium conditions. The resulting practical data are the object of this invention.

The school of thought at the base of this work is contained in the M. V. Ginatta Ph.D. Thesis. Energy Changes in Electrochemical Processes—The Electrodynamic Model and the Thermoelectrode, Colorado School of Mines, Department of Metallurgical Engineering, Golden, Colo., 1973).

The descriptions which will follow are intended for illustrating the characteristics of the Ti system within the requirement of the patent application, therefore without the use of rigorous irreversible thermodynamics formalisms. The aim is, through a better understanding, to achieve one of the object of this invention that is improving the electrolytic process technology.

2) BACKGROUND OF THE INVENTION

Presently the electrolytic production of titanium is performed in molten chloride systems and the metal produced has the form of pure crystals.

The industrial problem of chloride electrolysis is that titanium is deposited in the solid state on the cathodes with crystalline morphologies of large surface areas and low bulk densities.

The growth of the solid cathodic deposit requires its frequent removal from the electrolyte by means of handling apparatus of the kind described in U.S. Pat. No. 4,670,121.

The titanium deposit stripped from the cathodes retains some of the electrolyte entrained among the crystals, and the subsequent operation of removing the entrapped residual electrolyte, inevitably decreases the purity of the metal produced, which instead is very pure at the moment of its electrolytic reduction on the cathodes.

Also, the electrochemical characteristic of titanium deposition onto solid cathodes limits the maximum current density at which the electrolysis can be operated to relatively low values with correspondingly low specific plant productivity.

Further, in order to obtain crystalline deposits, the concentration of titanium ions in the electrolyte must be in the range requiring a separation between the anolyte and the catholyte as described in U.S. Pat. No. 5,015,342.

The electrolytic production of titanium in the liquid state has several operating advantages with respect to the production of solid deposits, as for example:

the cathodic area does not vary with the progress of the electrolysis, thus the achievement and control of steady-state operating conditions is easier;

the separation of the pure metal produced from the electrolyte is complete and does not require any further operation besides solidification and cooling under a protecting atmosphere;

the harvesting the metal produced can be performed without disturbing the progress of the electrolysis, as it will be explained in the description of the invention.

The electrolytic production of titanium at temperatures around its melting point has a very important thermochemical advantage, since the titanium lower valence compounds have a very low regime concentration, within the electrolyte, at those temperatures; therefore, there are no disproportionation or redox reactions to affect the current efficiency of the process (FIG. 9).

The electrolytic production of titanium at temperatures above its melting point has a very important electrochemical advantage, since the exchange current density values on liquid Ti cathodes are very much higher than those on solid Ti cathodes.

Furthermore, the addition of a minor ionic compound to the main electrolyte component, further increases the values of the exchange current density, since does not allow the formation of ionic metal complexes which are responsible for slowing the cathodic interphase processes.

3) BRIEF STATEMENT OF THE INVENTION

One of the object of the present invention is the electrolytic reduction of titanium metal in the liquid state.

An object of this invention is the use of the thermal blanketing provided by the electrolyte, in order to maintain a large pool of liquid titanium which grants the operation of full liquid cathodes. This mode of operating permits the use of much higher current densities with respect to solid cathodes.

Another object of this invention is the complete separation of titanium from the electrolyte in the cathodic interphase during the electrochemical reduction at high current densities.

Another object of this invention is the accurate control of the electrochemical half reactions occurring at the cathode, by means of the monitoring system which also actuates the variations of the process electrochemical parameters.

Another object of this invention is the use of a further advantage of the electrolysis with liquid cathodes, consisting in the possibility of operating the reduction of the metal from a low concentration of titanium ions in the electrolyte, while maintaining high current densities, and achieving high current efficiencies.

For titanium electrochemical systems, a specific electrolyte is not available, that is, equivalent to what cryolite is for aluminum, which could allow the feed of titanium oxides to the cell and obtaining titanium metal with a oxygen content within current trade specifications.

However titanium has the advantage of a large worldwide production of titanium tetrachloride of high purity which is mostly dedicated to the pigment industry.

Since titanium mineral concentrates must, in all cases, be purified of impurities, we may as well use the well established carbochlorination process to purify titanium raw material, just as the aluminum industry use the Bayer alumina refining process.

What could be further advantageous in order to reduce the cost of titanium electrolytic production would be the commercial establishment of a second type of titanium tetrachloride of a lower purity, and of a lower cost, with respect to the grade used for pigments.

This for two order of considerations:

the inherent refining capability of molten salt electrolytes which can maintain in solution some of the impurities or can separate others as vapor;

some of the elements which are regarded as impurities by the pigment industry, are actually alloying metals for titanium alloys (for example: V, Zr, Al, Nb)

It is understood that this second brand of titanium tetrachloride could only be obtained by the producers when the volume of the production of electrolytic titanium will be larger. Another object of this invention is a method for dissolving titanium tetrachloride in the electrolyte. Since $TiCl_4$ has a very small solubility in molten salts, but the reaction kinetics of $TiCl_4$ with calcium is very fast, the operating conditions that this invention teaches are such that a concentration of elemental calcium be present in the electrolyte.

Calcium is coreduced at the cathode when titanium ion concentration is maintained at low values and, being almost insoluble in titanium, elemental calcium diffuses in the body of the electrolyte towards the volume in which $TiCl_4$ is being fed.

Another object of this invention is the method for feeding titanium raw materials to the electrolyte.

One of the possible embodiments in which $TiCl_4$ is fed is through the passageway in the body of the insoluble anode, carried by a tubing, preferably made of a chemically inert material and not electrically conductive, such as BN and the like, so as to separate the volume in which $TiCl_4$ reacts with calcium, from the anodic interphase in which chlorine gas is evolved.

As another embodiment object of this invention, chlorine gas coming out of the electrolyte goes up into the space between the electrode side and the cell enclosure inner wall. The wall of the cell structure is preferably cooled to enhance the solidification of the vaporized bath constituents onto the inner wall, to obtain a protection for the structure metal from the attack of chlorine gas.

Another object of this invention is a method to minimize the dismutation reaction $$(3Ti^{2+}=2Ti^{3+}+Ti^{\circ})$$

and to benefit from its effects.

The low titanium concentration of the electrolyte, taught by this invention, favors the establishment and the maintenance of the equilibrium. The circulation movements of the electrolyte under operating conditions bring elemental titanium near the cathodic interphase where it coalesces into the liquid metal.

Conversely, some of the titanium ions that are carried near the anodic interphase are oxidized to tetrachloride, which is very effective for eliminating the current density limit constituted by the anode effect.

Furthermore elemental titanium present near the feeding point of titanium tetrachloride reacts with it to give lower valence titanium ions.

Another object of this invention is the method by which the absolute amounts of all of these reactions are minimized by the presence of the taught concentration of elemental calcium dissolved in the electrolyte, which reacts very effectively and maintains the steady-state operating conditions.

Another object of this invention is a method for assisting the prereduction of $TiCl_4$ by using an electronically conductive means for feeding the compound, connected with the negative terminal of a separate power supply, or to the apparatus power supply through a current control mean, in analogy with the teaching of U.S. Pat. No. 5,015,342.

This operating mode is taught for ensuring a complete absorption of $TiCl_4$ by the electrolyte at high rates of titanium production, but it is not always required.

Another object of this invention is a method for monitoring the temperature of the electrolyte, and gives readings which are not disturbed by the apparatus currents.

A temperature probe is conveniently installed within the tubing which carries the titanium raw material feed within the anode body.

The temperature at that location is representative of the resistance heat produced by the electrolysis current, and the temperature reading is accurate.

Instead on the outside of the anode the cooling effect of the cooled structural wall produces solid electrolyte crust which hinders the temperature measurement.

Another object of this invention is a method for controlling the temperature of the electrolyte in order to maintain the steady-state operating conditions with a cathode liquid metal pool of a optimum depth.

Another object of this invention is a method for maintaining a steady-state production of electrolytic titanium.

In the operating conditions, taught by the invention, $TiCl_4$ is a gas, but at ambient temperature it is a liquid which is very conveniently handled by a metering pump. By entering the passageway within the working anode $TiCl_4$ is vaporized, and further heated passing in the feed tubing.

Under the described conditions the rate of $TiCl_4$ absorption by the electrolyte is very fast and its efficiency is almost unity.

The set of operating conditions object of this invention, makes very easy the regulation of controls for the rate of feeding of $TiCl_4$, in order to be proportional to the direct current supplied to the apparatus.

Another object of this invention is a method for using graphite as an insoluble anode materials in molten fluorides.

The selection of $TiCl_4$ as the raw material as thought by this invention makes carbon electrodes behaving as insoluble, therefore minimizing the tendency of producing chlorofluocarbon compounds, which are unstable anyway at the temperature of the operations, which are within the range used for the thermal decomposition of these compounds into the incinerators.

Another object of this invention is the geometrical configuration of the anode, in particular of its part immersed in the electrolyte.

We have found that for maintaining an even current distribution through the electrolyte the anode is preferably shaped as an inverted cone. Also the presence of radial groves enhance the evolution of anodic gas bubbles.

Another object of this invention relates to the methods for harvesting the metal produced.

The simpler method is that in which the liquid metal pool within a cooled crucible, gradually solidifies and becomes an ingot which grows in height with the progress of the electrolysis.

In the apparatus object of the invention the anode is insoluble and thus does not change its length during the metal production; therefore a means for raising the anode in order to maintain constant all the electrochemical parameters is provided.

The end of the raise is reached when the ingot has grown up to fill the crucible; at that point the electrolysis is interrupted to allow the harvesting of the ingot produced, and then restarted for the continuation of the process.

A more elaborated way of harvesting the metal produced is similar to that used in the continuous casting of metals, in which the growing ingot is gradually removed through a bottomless crucible.

In the apparatus object of this invention, a level control system raises and lowers the insoluble anode within the interval required to follow the ingot growth and downward movement, in order to maintain constant the operating parameters of the electrolysis.

A method for harvesting of metal produced still in the liquid state is taught in the U.S. Pat. No. 5,160,532 by Mark G. Benz and regards the cold finger orifice controlled by induction melting.

Another object of this invention is the retrofitting of the cell with the cold finger induction orifice control system as a preferred configuration for the tapping of the liquid titanium produced.

This is a discontinuous operation that must be synchronized with the anode level control, but it is essentially continuous for large cathodic areas cells.

Another object of this invention is the direct production of titanium alloys by using the apparatus as described.

The alloying elements are introduced in the electrolyte both together with the $TiCl_4$ feed making use of their solubilities, and added through a solid feed port as metals, as master alloys, as compounds.

The required chemical composition of the produced alloys is a function of the electrochemical characteristics of the alloying metals, and thus times and amounts fed are set to achieve the target specifications for the produced alloys.

Another object of this invention is the high homogeneity of the alloys produced, as compared to the traditional melting technologies. This is due to the low rate of metal transfer, as compared to the rate of transfer in ingot melting, that, coupled with the electromagnetic stirring of the liquid metal pool, caused by the passage of the electric current, results in the production of very homogeneous metallic alloys.

Another object of this invention is the direct production of metal plates of large surface area, that permits the saving of the costs of metallurgical work for transforming cylindrical ingots into blooms and slabs and than into plates, especially for difficult to mill alloys.

Another object of this invention is the direct production of metal billets intended for the metallurgical transformation in long metal and alloy products, which saves expensive metallurgical work and metal scrap generated during the processing of large cylindrical ingots.

4) BRIEF DESCRIPTION OF THE DRAWINGS

The process and apparatus object of the invention will be described in greater detail by means of working examples which will follow, and with reference to the appended drawings wherein.

DEFINITIONS

1) The Cathodic Interphase is a three-dimensional medium (not a two-dimensional interface), that is, a volume in which the electrode half-reactions occur; it is located between the electronically conductive cathode and the ionically conductive electrolyte.

Within the thickness of the cathodic interphase, there are steep gradients in the concentration of the ions and of the atoms, and in all physico-chemical variables. For example, the electrical conductivity value goes from the electronic mode at 10,000 ohm-1 cm-1 in the bulk of the metallic electrode, to the ionic mode at 1 ohm-1 cm-1 in the bulk of the electrolyte. Inside the interphase the energy density has very high values, that is the notions of solid, liquid and gas are not applicable.

For details see page. 163 of Energy Changes in Electrochemical Processes—The Electrodynamic Model and the Thermoelectrode, Colorado School of Mines, Department of Metallurgical Engineering, Golden, Colo., 1973).

2) All the cathodic and anodic processes are driven by the DC power supply (which is external to the cell, but part of the electrochemical system) which applies an electric field (difference in potential energy of electrons) between an electronically conductive cathode and an electronically conductive anode.

3) Under common operating conditions of Ti cells, the difference in decomposition potentials between Ti compound and K compound is small, that is, it can be stated that the process of Ti reduction is only slightly thermodynamically more noble than the process of K reduction.

4) The ionic diameter of Ti+ is about 1.92 A°; it can be stated that the process of reduction to Ti° is not kinetically privileged with respect to the K° reduction.

5) The role of ionic current carrier in the electrolyte is almost totally done by K+: t+=0.99.

5) BASIS OF THE INVENTION

The process objects of this invention provides conditions for the reduction of titanium multivalent species to titanium metal.

Figure 10:
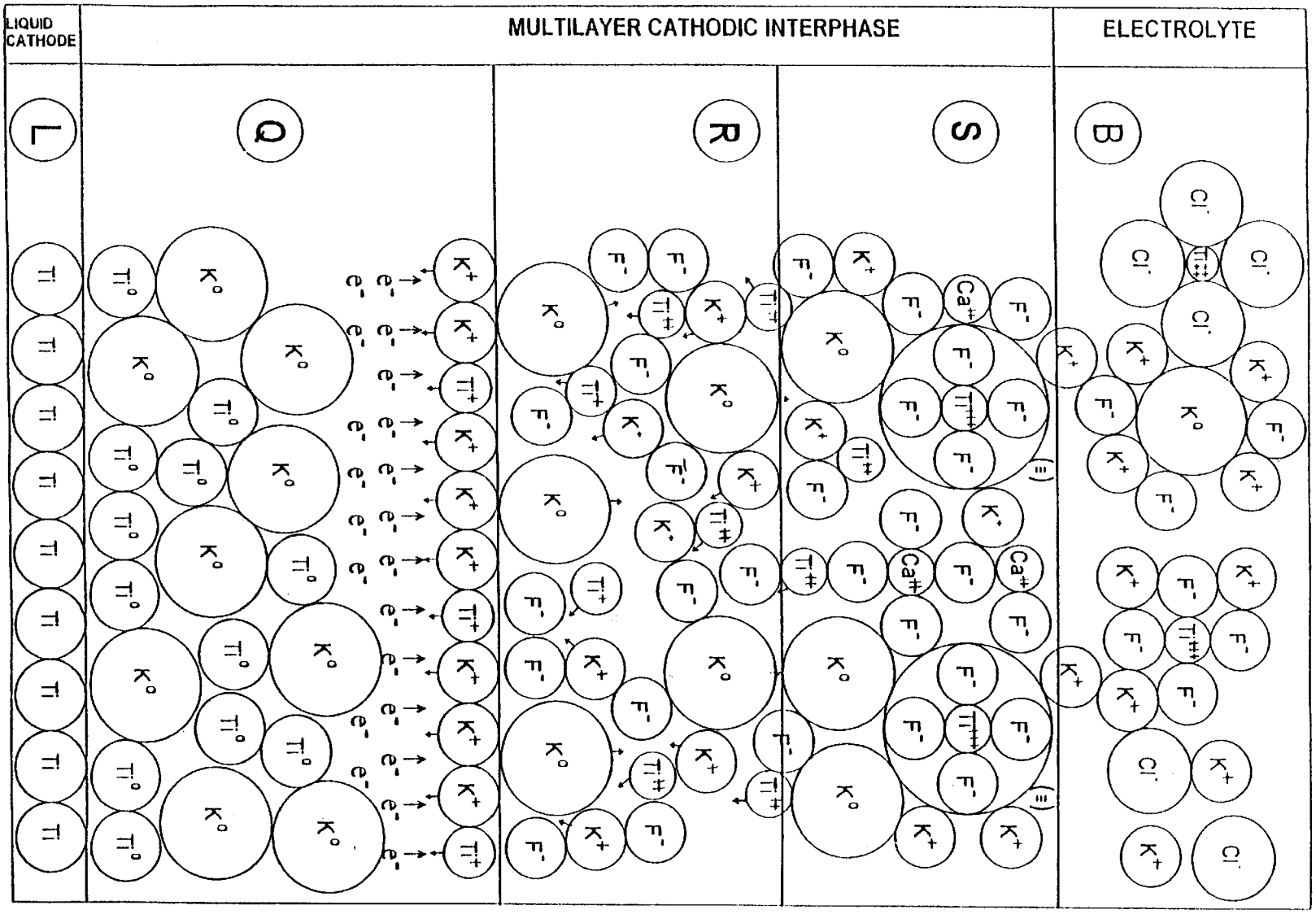
FIG. 10 is a schematic drawing of the microscopic model for the cathodic interphase under dynamic steady-state operating conditions.

The attached schematic drawings (FIG. 10) summarizes the microscopic mechanism which is believed to occur within the thickness of the cathodic interphase in the electrolytic production of liquid Ti, according to the electrodynamic model proposed by M. V. Ginatta, Ph.D. thesis, Colorado School of Mines Energy Changes in Electrochemical Processes—The Electrodynamic Model and the Thermoelectrode, Colorado School of Mines, Department of Metallurgical Engineering, Golden, Colo., 1973).

The microscopic mechanism represents the real dynamic steady-state operating conditions in which there are chemical reactions and electrochemical reactions, occurring simultaneously, but at a different locations, driven by the gradient of the electrochemical potentials, that is the local chemical potential of the species, induced by the externally applied electric field.

To facilitate illustrating the process object of this invention, the description will begin with the electrolytic cell start up operations and will progress towards the steady-state regime conditions, with the assumption that the cathodic interphase is a multilayer.

The system comprises an electrolyte constituted by $CaF_2$, KF, KCl and elemental K, Ca, a liquid Ti metal pool as the cathode, and a $TiCl_4$ injection means.

The DC power supplied by the rectifier, at a low voltage and low cathodic current density, causes the reduction of K° on the liquid Ti metal pool cathode, in which K has very little solubility, with simultaneous $Cl_2$ evolution at the non-consumable anode.

With the progress of the electrolysis, the concentration of K° in layer Q increases, with respect to the low concentration of KO in layer B.

At the start up, the layers R and S are thought as not being present yet.

This mode of operation generates a chemical potential difference between Q and B, which drives K° away from Q into B.

The K° enters B, where it reacts with the $TiCl_4$ which is being started to be injected, to produce $K_3TiF_6$, which is a stable complex of $Ti^{3+}$, and KCl which is a stable chloride.

For Coulomb interaction, the triple charged, small, $Ti^{3+}$ ion, can go to bind $6F^-$ at a very small interionic distance, thus with great bonding energy.

$Ti^{3+}$ is a small ion since it has lost 3 electrons, over a total of 22, and thus, being that the positive charge of the nucleus unchanged, the remaining 19 electrons, having to share the same total positive charge, are attracted much closer to the nucleus.

In fact Ti° atomic diam. is 2.93 Å, while $Ti^{3+}$ ionic diam. is 1.52 Å, which is 1/7 in volume.

Thus, at low current density (e.g. <1. A/cm$^2$) the cathodic system is composed of only the B layer, in which $K_3TiF_6$ is formed, and the Q layer in which K° is reduced.

By increasing the voltage, thus the current density, with the production of more K°, the layer R is created, and the destabilization of $K_3TiF_6$ is induced with the formation of $TiF_6^{(3-)}$ and $3K^+$ which creates the layer S.

The complex $TiF_6^{(3-)}$ cannot enter R, much less Q, because its overall charge is very negative.

The K° arriving from R, approaches the complex $TiF_6^{(3-)}$ in S and use $F^-$ for transferring 1 electron to $Ti^{3+}$, which expands to $Ti^{++}$ (ionic diam. 1.88 Å, that is double in volume) and thus releases the $F^-$.

This reaction generates as a product $Ti^{++}$, which is a double charged ion, that has an average dimension, it is not complexed by $F^-$, and it is driven towards the cathode by the ionic electric field, much in the same way as the other cations.

Thus $Ti^{++}$ entering R along with $K^+$, encounters K°, which has a higher chemical potential, coming from Q, and thus it reduces $Ti^{++}$ to $Ti^+$. In fact in R the chemical potential of K is greater than in S, but not high enough for producing Ti°.

Now $Ti^+$ is a single charged ion, with dimensions comparable to $K^+$; it is driven by the ionic electric field to enter Q along with $K^+$ and it is co-reduced to Ti° together with K°, by the electrons available in Q.

Ti° coalesces into the liquid Ti pool, and K° having very low solubility in Ti, accumulates on top of the Ti pool.

Therefore, at medium current densities (e.g. >1. A/cm$^2$) there is the establishment of the layer S in which $K_3TiF_6$ is decomposed and $Ti^{++}$ formed, and of the layer R in which $Ti^{++}$is further reduced by K° to $Ti^+$.

The cyclic voltammetric analysis confirms in part the above microscopic mechanism for the start up conditions; in fact, coming from anodic and going towards cathodic potentials at 0.1 V/sec, there is a series of peaks that can be assumed to represent a series of steps at which partial reduction/oxidation reactions occur.

However, cyclic voltammetric results give only limited information since they are measurements of unsteady-state transient conditions.

Besides, some of this step partial reactions have extremely fast kinetics, and the exchange current densities of these cathodic systems have very high values.

By further increasing the voltage of the power supply, we increase the electrical potential difference between the pool of Ti and the layers boundary Q/R, with the effect of supplying more electrons to Q (higher cathodic current density) to reduce more K+ and Ti+, with the final result of producing more K° and more Ti metal.

The chemical potential of K° in Q becomes much higher that of K° in R, and thus in S, with the effect that more K° is driven out of R into S, to react with more $TiF_6^{(3-)}$, and to reduce more $Ti^{++}$; which then enters R to be reduced to $Ti^+$ by more coming K°.

Also the physical thickness of the Q, R and S layers increases with the applied greater current density values, along with the increase of the chemical potential of KO in R and in Q.

Continuing with the multilayer assumption for the purpose of facilitating the illustration of the object of the invention, the higher cathodic potential differences applied by the power supply and the resulting increasing cathodic current densities, produce a thickening of the cathodic interphase, with the establishment of a well characterized series of layers, within each of them, a specific step of the multistep reduction reaction takes place.

The multilayer structure of the cathodic interphase is dynamically maintained by the applied power of the DC rectifier.

In each of the layers constituting the cathodic interphase, there are different values of electrochemical potentials for the species involved. This dynamic steady regime allows the stepwise reduction of multivalent ions, one electron at a time, in well defined different layers. These are the loci of the discrete discontinuities that are the main characteristic of the electrochemical systems.

For steady-state regime operating conditions, we can summarize which reactions is concurrently occurring where, according to the microscopic mechanism, as follows:

in B: $TiCl_4+K°+6KF=K_3TiF_6+4KCl$, both stable products;

in S: $K_3TiF_6+K°=4KF+TiF_2$, both unstable ionized products;

in R: $K°+Ti^{++}+2F^{--=K+}+2F^{-}+Ti^{+}$;

in Q: $3K^{+}+3é=3K°$ and $Ti^{+}+é=Ti°$.

Now, by considering this proposed microscopic mechanism in more detail, we can see the possibility of electron transfer through a bipolar mechanism of K°, that is, the exchange of electrons between K° (atom) and the adjacent $K^{+}$ (ion), thus transferring the electric charge, in the direction of the electrolyte, without physical mass transfer.

This consideration may explain why there is no measurable cathodic overvoltage in this type of cell, even at high current density values.

With some analogy with the process of electrolytic metal refining processes with bipolar electrodes, we may go further and think that, under steady-state operating conditions, it may be no need for more net reduction of further K°, since its chemical potential gradient from Q to S is being maintained by the electron transfer and countercurrent $Ti^{+}$ migration.

The understanding of the importance of the role in which $K°/K^{+}$ are engaged in this type of cells, may also explain:

why the K content of the Ti produced, is below the equilibrium data, and why the current efficiency increases with increasing the current density, and why, after the power supply has been shut off, the back e.m.f. remains for minutes, producing a depolarization curve of a particular shape; that is, at first, the layer Q may be thought as to work as a discharging battery negative electrode, consuming $K°=K^{+}é$; than, the resulting decrease of chemical potential of K° in Q, drives K° from R and from S into Q, that is making the interphase work as fuel cell anode, until there is K° in B.

However, the start up mechanism of the electrolysis is not exactly the reverse of the depolarization phenomenon.

On solid cathodes, only the very initial starting conditions can be represented by the microscopic mechanism, since, soon after, the crystallization generates discontinuities on the metal surface which destroy the uniformity in current density distribution. The microscopic mechanism can only occur at the tip of the growing dendrites, while the roots at the starting cathodic surface are not electrochemically working any more.

Some of the embodiments illustrated in the present invention are based on establishing the above mechanism for the electrolysis.

However, other embodiments of this invention are based on the following considerations.

The large scale operations of the chloride process as taught by U.S. Pat. No. 5,015,342, always showed that the anolyte contained in the composite electrode (TA) comprising the bipolar titanium electrode (TEB), was free of Ti ionic species (at all times it was pure white NaCl). The Ti lower valence ions that seeped through the TEB, were completely precipitated as Ti crystals by elemental Na which was present on the frontal side of TEB. This was confirmed by the absence of $TiCl_4$ in the $Cl_2$ anodic gas evolution under regime steady state operations.

The $TiCl_4$ was detected in the anodic gases only when the Ti crystals accumulated in large quantities at the TA bottom, as a result of a malfunction of the TEB. The Ti crystals accumulation wrapped the graphite anodes and started being chlorinated by the nascent $Cl_2$.

Thermodynamic equilibria analysis made in the 1980's confirmed that, in the presence of alkali metals and alkaline earth metals, the reduction of $TiCl_4$ to Ti crystal, at 1100° K, is complete with near zero equilibrium concentration of Ti lower chlorides in the electrolyte.

The consequent solution of the above chloride process problem, was the continuous removal of the Ti crystal produced within the TA, which, however, involved elaborated engineering plant design.

Figure 9:
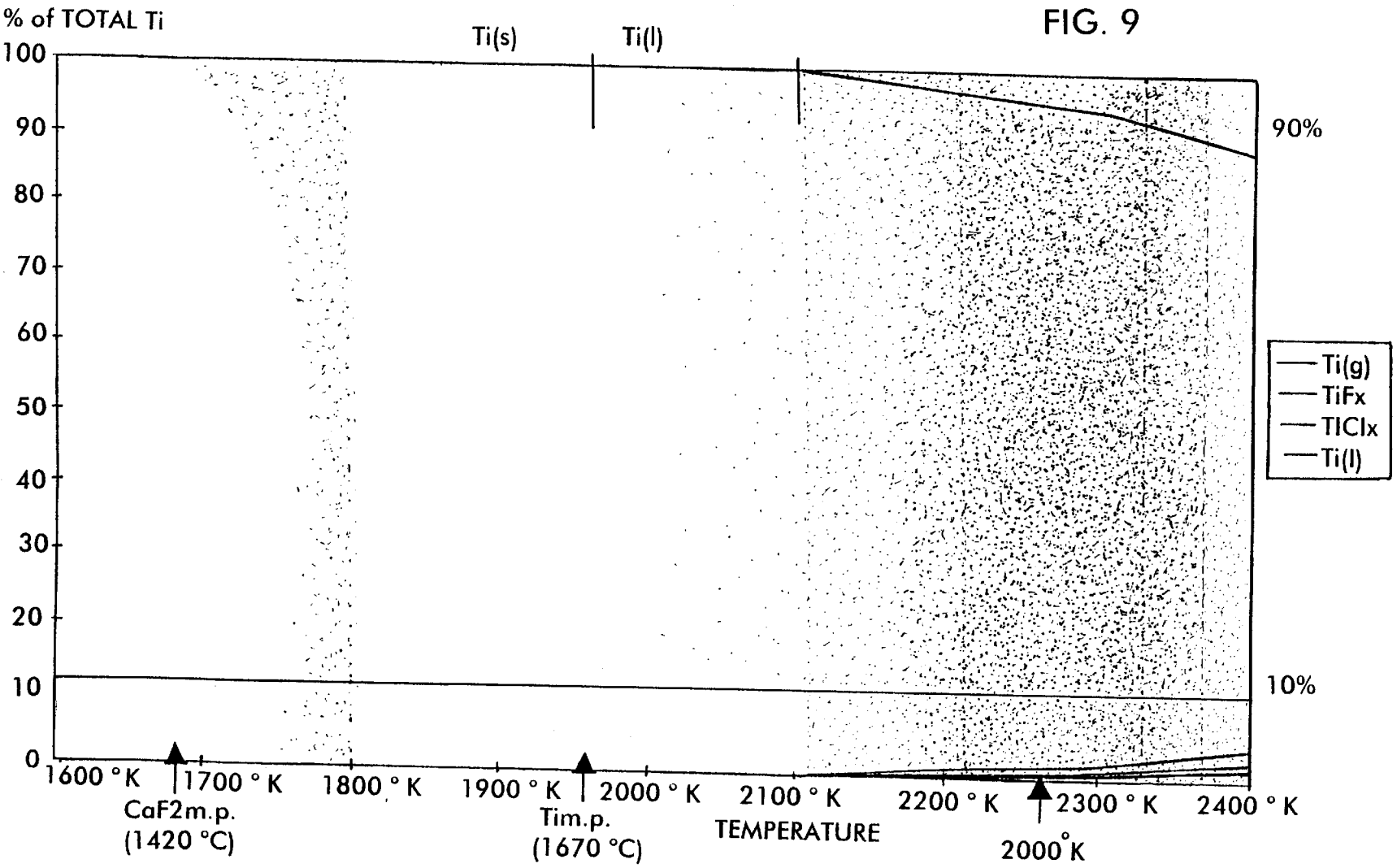
FIG. 9 is an equilibrium diagram of the variation of the concentration of the titanium species with temperature.

However, further thermodynamic equilibria analysis showed that the above operating conditions exist up to 2200° K, both for chlorides and fluorides, and at this temperatures all Ti present is liquid, with near zero concentration of Ti lower valence ions (FIG. 9).

These are some the reasons why the electrolytic process taught by this invention produces Ti in the liquid state and does not require diaphragms.

Further thermodynamic analysis showed the beneficial effects on the process taught by this invention, obtained by the combined action of monovalent alkali metals and divalent alkaline earth metals present in the electrolyte, as for example, Ca°+K°, Ca°+Na°, or any other combination like Ca°+Mg°.

These operating conditions, not allowing stable metal complexes to form, result in further increases of exchange current density values, and thus of allowed process current density.

Operating at high temperature is further beneficial because the differences in the decomposition potential at 2100° K between the alkali metals and alkali earth metals fluorides, and titanium fluorides, are much less than the differences at 1100° K.

In fact, the negative temperature coefficient value for titanium fluorides (0.63) is much smaller than those for the alkali metals and alkaline earth metals fluorides (1.06); this means that with increasing temperatures, KF decomposition potential decreases more rapidly than that of $TiF_2$.

Lastly, the most appropriate concentrations of the species, for codeposition, are determined by activity coefficient calculations.

Concluding, the melting point of Ti, 1943° K, being within the temperature interval indicated above, permits the operation with liquid cathodes, with all the electrochemical and operative benefits mentioned above.

From the results of the microscopic mechanism and of the thermodynamic analysis, it became very evident the need for engineering efforts to invent electrolytic cells which operate within the window of conditions indicated above.

That is, one of the objects of this invention is the electrolytic cells that make use of the very fast kinetics, and the very high exchange current densities of molten salts electrolytes, which work best at high current density regimes producing liquid metals.

The presence of minor constituents in the electrolyte, that is chlorides additions, increase the ionic electrical conductivity of the electrolyte; therefore, for a constant joule heat formation rate, a thicker electrolyte can be used than in pure $CaF_2$, that is a larger distance between cathode and anode can be maintained for the same applied voltage.

This mode of operation is beneficial for limiting the back reaction of $Cl_2$ recombination with dissolved Ca° in the electrolyte.

6) DETAILED DESCRIPTION OF THE INVENTION

The process object of this invention comprises the simultaneous occurrence of chemical reactions in the bulk of the electrolyte, and of electrochemical reactions in the anodic and cathodic interphases.

To help the illustration of the invention, the method and the apparatus according to the present invention are described in details by means of the following embodiments of working examples.

EXAMPLE 1

The apparatus described in the following example allows the electrowinning of titanium and titanium alloys from its compounds, particularly fluorides, chlorides, bromides and iodides, through electrolysis in a molten salt electrolyte kept at a temperature higher than the melting point of titanium and its alloys.

Figure 1:
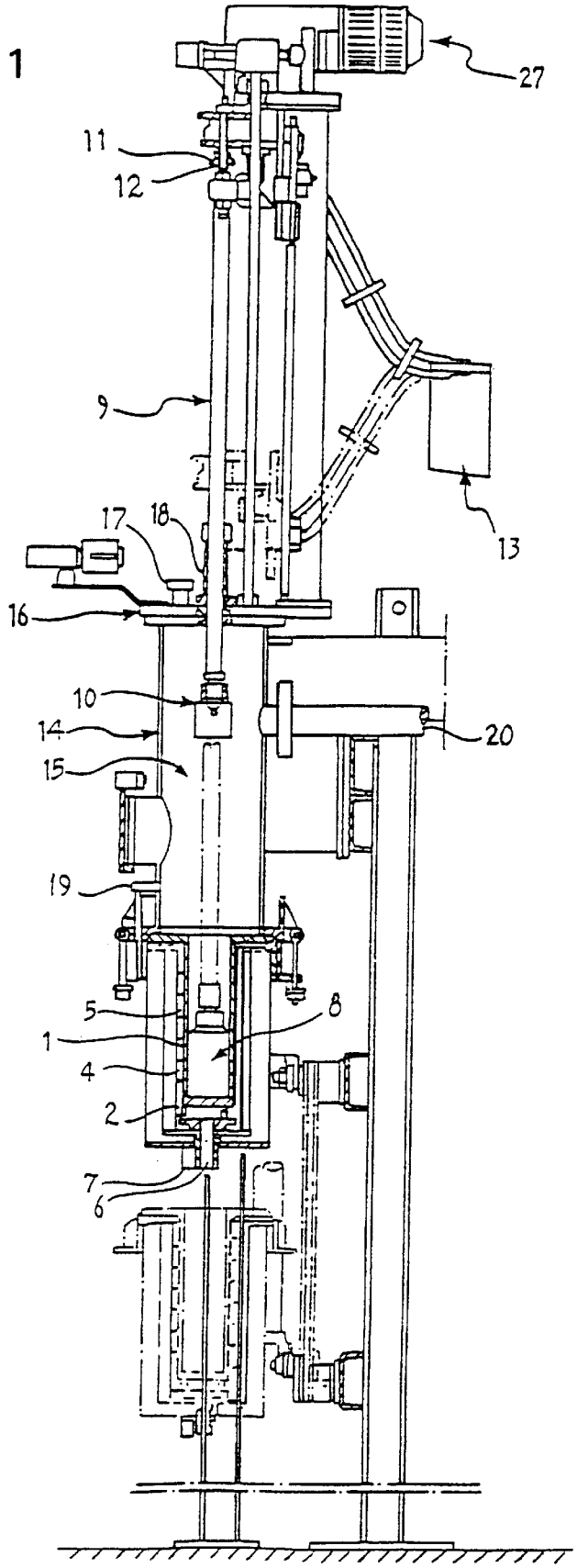
FIG. 1 is a partially-sectioned front view of an apparatus for carrying out the process according to the invention.
Figure 2:
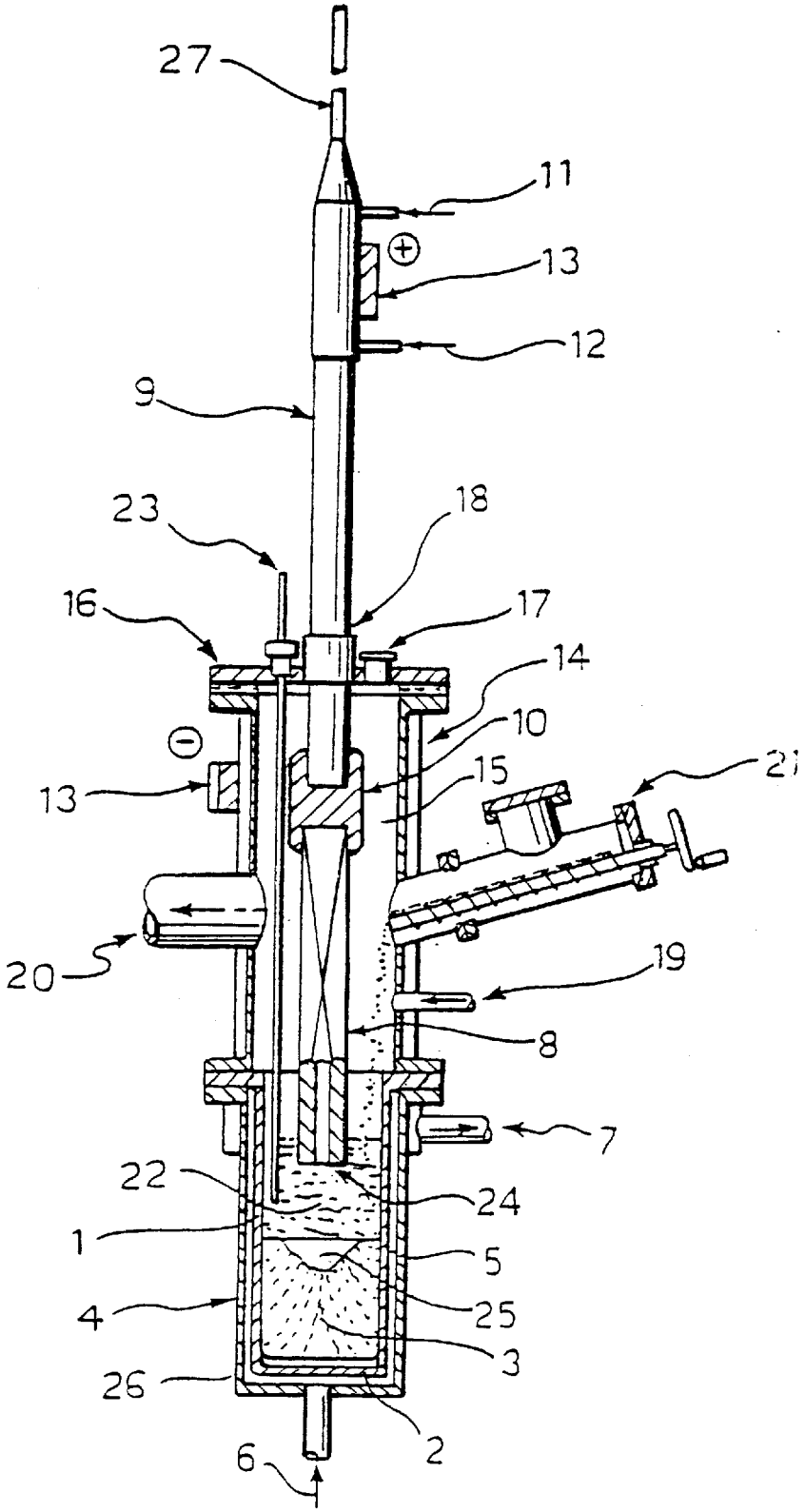
FIG. 2 is a partially-sectioned front view of an apparatus for carrying out the process according to the embodiment of example 1.

The apparatus vertical view of FIG. 1, is semischematically illustrated in FIG. 2, and comprises of a cathode 1, consisting preferably of a copper cylinder, which is closed at its lower end 2 to allow the crystallization of a titanium ingot 3.

The internal diameter of the copper cylinder is e.g. 165 mm, height 400 mm, wall thickness 12 mm.

The cathode-crucible 1 housed in a vessel 4 which is closed at its lower end and is greater in size than the copper crucible so as to define an hollow space 5, which constitutes a water jacket for the circulation of cooling water.

Water, or another cooling fluid, is fed to the jacket through water inlet 6 at a temperature of about 15° C. and exited through water outlet 7 at a temperature of about 30° C., with a velocity of 3 m/sec.

With 8 is indicated an anode, which is a cylindrical electrode, coaxial and concentric with the crucible, made of graphite, having a diameter of 80 to 120 mm. The anode tip is preferably in the shape of an inverted cone for better current distribution through the electrolyte, and it has radial grooves to enhance chlorine gas evolution.

The anode is connected to a water-cooled bus bar 9, by means of a nickel plated copper clamp 10. Inlet and outlet for the cooling water are indicated respectively with reference numerals 11 and 12. The bus bar 9 is connected to the positive terminal of a power supply 13.

The cathode-crucible is connected and air-tight sealed to a cover 14, made of stainless steel, which defines an inner chamber 15, to avoid the transfer of oxygen from the atmosphere to the ingot. The cover is provided with a lid 16 having an observation port 17, and the bus bar 9 is inserted into the lid by means of a vacuum-tight gland 18. The process can however also be carried out in plants without a closing cover making use of the protection offered by the crust of solidified electrolyte.

A protective argon atmosphere can be introduced into the chamber 15 through inlet 19 and then vented through outlet 20.

The cover 14, that is in electrical contact with the cathode-crucible walls, is connected to the negative terminal of the power supply 13 to allow the coaxial current feeding.

The apparatus is provided with a feeder-conveyor 21 which is integral with the cover to introduce solid electrolytes and the alloying elements under controlled atmosphere conditions. Molten salt electrolyte contained in the crucible is indicated as 22.

The electrolyte consists preferably of mixture of $CaF_2$ (99.9% pure) and calcium (99% pure) in grains of 3–6 mm in size to permit a regular start up procedure, and it is kept liquid at the desired temperature of about 1750° C. by the energy dissipated by Joule effect of the current passing through the electrolyte. The weight ratio in the $Ca/CaF_2$ electrolyte is, for instance, 1:10; in addition, other salts may be added to the electrolyte in order to optimize the anodic and cathodic reactions.

In order to obtain the production of metals of the highest purity, an ESR melting of the electrolyte is a preferred procedure for purifying the $CaF_2$. It is performed in a water-cooled Mo—Ti—Zr alloy crucible with a titanium electrode at a temperature below the melting point for Ti, in order to fuse only $CaF_2$ (m.p. 1,1420° C.) and eliminate its contaminants.

The amount of salt introduced into the crucible is such to provide for a electrolyte height of about 25 to 75 mm, and the level at which the graphite electrode 8 is immersed in the molten salts is determined considering that $CaF_2$ has a specific electrical resistivity of 0.20–0.25 ohm cm at 1900–1650° C.

A potential difference of 5 to 40 V for example, is applied between anode and cathode by feeding a direct current which can be adjusted between about 3,000 and 15,000 Amp.

At the start, and whenever it may be needed, an alternating current is applied to ensure the reaching of the desired temperature in the molten electrolyte.

The process may also be carried out with combined heating systems, by providing an additional heat source (e.g. plasma torches, induction heating, resistance heating and the like) to supply a portion of the energy required to keep the salt bath at the preferred temperature range between 1,700 and 1,900° C.

The compounds containing the metal to be extracted (e.g. $TiCl_4$, $TiF_3$, $TiBr_4$, $TiI_4$, TiC, in the case of titanium production) are fed both in the liquid and solid state by means of a feeder 21. $TiCl_4$ and other compounds which can be fed in the liquid and gaseous state are preferably fed to the electrolyte through the tubing 23.

The quantity of the alloying materials added are determined taking into account their partial equilibrium thermodynamic values in the process conditions; for example $AlCl_{13}$ and $VCl_4$ (which could be $VOCl_3$ if crude $TiCl_4$ is used) are fed in the embodiment of this invention for the production of ASTM Gr 5 titanium alloy.

In a preferred embodiment, the alloying elements which forms chlorides which are soluble in $TiCl_4$, are admixed with it and fed together into the electrolyte through the duct 23.

The feeding cycle for alloying materials which are fed in the solid state are within 10–30 minute periods depending on the solubility limits for the alloying materials in the electrolyte at the operating conditions, and are preferably fed with the feeder 21.

The gaseous products generated by the electrolysis, such as $Cl_2$, $F_2$, $Br_2$, $I_2$, $CO/CO_2$ are removed preferentially by a coaxial duct 24 inside the anode 8.

The following reactions are believed to take place inside the electrolyte:

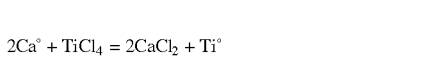

$$2Ca^{\circ} + TiCl_4 = 2CaCl_2 + Ti^{\circ}$$

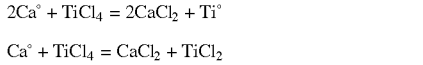

$$Ca^{\circ} + TiCl_4 = CaCl_2 + TiCl_2$$

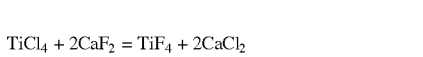

$$TiCl_4 + 2CaF_2 = TiF_4 + 2CaCl_2$$

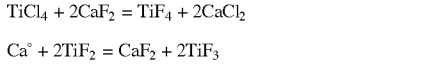

$$Ca^{\circ} + 2TiF_2 = CaF_2 + 2TiF_3$$

and at the electrodes:

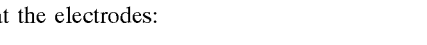

$$TiCl_2 = Ti^{\circ} + Cl_2$$

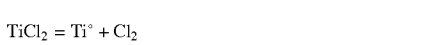

$$TiF_3 = Ti^{\circ} + 3/2F_2$$

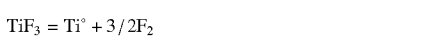

$$F_2 + 2Cl = 2F^{-} + Cl_2$$

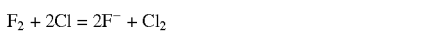

$$CaCl_2 = Ca^{\circ} + Cl_2$$

The above reactions only summarize the final result of the chemical and electrochemical mechanisms which occur in the cell, and products which are obtained. Similar reactions are believed to involve the alloying elements and compounds in the embodiment of this invention for producing metal alloys.

Calcium metal, released by its chloride, diffuses in the electrolyte and it is available for the reduction of titanium tetrachloride. Alternatively, calcium chloride may be added to the electrolyte instead of elemental calcium.

Titanium obtained at the electrolyte temperature is collected in the liquid state into the cathode, by forming a liquid metal pool 25 and it is allowed to solidify therein.

The copper crucible is protected against the fluoride ions corrosive attack, by a layer of slag 26 which solidifies in contact with the cooled walls. The thickness of that layer is kept at about 1–3 mm.

In the course of the process, under steady state conditions, the metal ingot 3 that forms inside the crucible grows vertically in height.

The apparatus object of this invention is provided by a process control system to regulate the vertical movement of the cathode-electrolyte-anode assembly, by means of an anode drive system 27 to ensure constant metal production conditions.

The control of the electrolytic production is preferably actuated by means of a current regulator that guaranties the continuous raising of the anode in order to maintain constant current supply conditions.

During the process, the control system adjusts the anode immersion depth in the electrolyte, following the advancing of the metal pool surface, in order that the current be kept constant at the set value.

This mode of operation can be summarized as follows, $$L = \frac{V_e S_a}{I r_e}$$

where:

| |
|---|
| L = distance between anodic surfaces and cathodic surfaces; |
| $V_e$ = voltage drop through the electrolyte; |
| $S_a$ = anode surface area; |
| I = current supplied; |
| $r_e$ = specific resistivity of the electrolyte. |

Only as an example, which is not meant to be restrictive, the values of cathodic current densities used are in the range from 1 A/cm$^2$ to 60 A/cm$^2$, with the preferred interval being between 10 and 50 A/cm$^2$.

The values of current densities used in the apparatus object of this invention, are higher than that for aluminum production, since for the case of titanium reduction for example, the metal fog phenomenon is less important. In fact, the difference in density between the liquid metal and the electrolyte, at their respective electrolysis operating conditions, is of only 0.25 g/cm$^3$ for aluminum, while is about 1.80 g/cm$^3$ for titanium.

This is also a reason why in the embodiments of this invention we can make use of calcium reduction of titanium ions in the bulk of the electrolyte and consequent coalescence of droplets into the liquid cathode.

Particularly, the cathodic interphase is a highly reductive environment for titanium ions which are directly reduced by electrons or through the help of calcium reduction oxidation mechanism. In fact, at the operating conditions of the electrolysis, calcium is codeposited with titanium on the liquid cathode surface, but having a very low solubility in titanium, calcium returns into the electrolyte.

In addition, the passage of the process current generates a vigorous electromagnetic stirring of the liquid metal pool which further enhances the mass transfer at the cathodic interphase.

Also the electrolytic gas evolution at the anodes produces a further acceleration of mass transfer rates which allow the use of high current densities.

Since $CaF_2$ has a very low electronic conductivity and a very high ionic conductivity, the electric charge transfer mechanism through the electrolyte is entirely ionic.

To better illustrate the physical significance of mass transfer, it is important to stress that the process object of this invention is an electrowinning of metals from their compounds dissolved in the electrolyte.

This process is the most comprehensive among all the metallurgical processes since it starts from the raw material, that is a compound in which the metal is contained in an oxidized ionic form, and, in only one apparatus it arrives to the production of the metal in the reduced, elemental, pure form.

Therefore the mass transport entirely occurs by means of the ionic current which goes through the electrolyte between the anode, that remains geometrically unchanged since it is not soluble under the electrolysis conditions, and the liquid cathode, using the energy for winning the decomposition potential of the metal compound dissolved in the electrolyte, and for liberating the metal and the anodic gas separately.

This electrowinning process is operationally much more complex and energetically more intensive with respect to the simple electrolytic refining process, in which the anode is made of an impure metal to be purified, that is already in its elemental reduced form.

A further simplified and accelerated mass transfer process is the electroslag melting in which the purification of the metal is minimal, being essentially the physical collapse by fusion of the upper electrode, the anode, because the temperature reached by the slag, as a result of the current passage, has overcome the melting point of the metal constituting the upper electrode. In this case the mass transfer is almost entirely elemental, by means of the fall of the metal in form of drops through the slag, and the contribution of the ionic mass transfer by the electrolytic refining process is minimal.

Instead, in the apparatus object of this invention, the positive electrode, the anode, not only is insoluble in the electrolyte but has a very high melting point, that cannot be reached by the temperatures of the operating conditions, thus allowing only the ionic electrochemical mass transfer mechanism to occur for the electrowinning of the metal from the electrolyte.

EXAMPLE 2

The apparatus described in the following example differs from that of example 1 in the cathode-crucible geometrical configuration which is made to obtain long slabs and ingots with some analogy with the metal continuous casting procedure.

Figure 3:
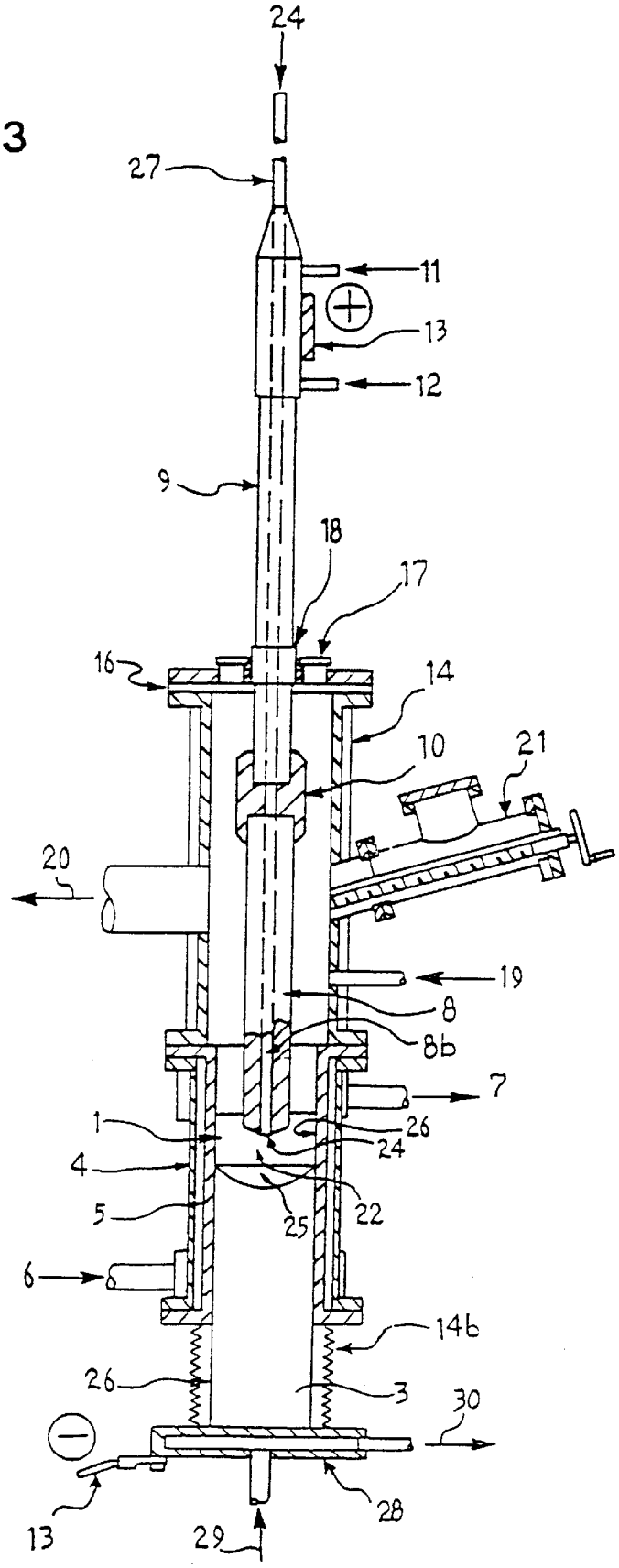
FIG. 3 is a partially-sectioned front view of an apparatus for carrying out the process according to the embodiment of example 2.

The main process parameters are similar and, in FIG. 3 the same reference numerals are used to indicate the same or similar components.

The cathode consists of a rectangular water-cooled copper mold 1 with its lower end closed by a retractable water-cooled base plate 28 provided with a water inlet 29 and outlet 30, to allow the extraction of a titanium ingot 3.

The base plate 28 is electrically connected to the negative terminal of the power supply 13, and it is water-cooled through inlet 29 and outlet 30.

The mold dimensions are for example as follows:
cross-section area: 200 $cm^3$
side-to-side ratio: 2–4
height: 1.5×internal longest side.

The anode 8 is rectangular and the ratio of the cross-sectional areas of the anode and ingot is in the range from 0.3 to 0.7.

The anode is made of graphite, the immersed part of which may be coated with a refractory material.

With the progress of the electrolysis, under steady state conditions, the amount of metal that forms in the mold increases. Since the mold is fixed, the base plate shall be made to move downwards by drive means that withdraw the ingot at a rate synchronous with the metal reduction rate.

The downward movement of the base plate 28, following the growth of the titanium ingot 3, is controlled by a electronic system which maintains constant the vertical location of the liquid cathode surface, of the pool 25, within the copper cylinder. In this way also the vertical position of the anode 8 is maintained constant to insure a constant electrolyte thickness.

The apparatus allows one to obtain ingots over 3 meters long, thanks to the retractable base plate. The outcoming ingot is already solidified but still at high temperature and in the case of a reactive metal (e.g. titanium and titanium alloys), it is preferably protected from the external atmosphere by a lower cover 14*b*.

The compounds containing the metals to be produced are preferably fed through the passageway 24 within the anode 8, in which a tube 8*b*, preferably made of a chemically inert and electrically non-conductive, is inserted in order to separate the volume in which $TiCl_4$ is reduced, from the anodic interphase in which anodic gases evolve.

The geometry of the inert tube 8*b* is such that it can slide inside the passageway 24, so to retract in order not to interfere with start up operations, and to slide down to a set position when the electrolyte is molten.

The gaseous byproducts are exited preferably through the outlet 20.

The feeder 21 is used preferably for additions of solid metal compounds, of electrolyte components, and alloying elements and compounds when alloy ingots are produced.

This example refers to an apparatus using a retractable base plate system, but the same results can be obtained by using a mold that is movable with all its ancillary equipment and a fixed base plate. A combination of both systems is also possible.

The apparatus described in this example permits to obtain ingots with excellent surface finish, which can be sent to the mill plant without any further metallurgical operation.

EXAMPLE 3

The apparatus described in the following example differs from that of example 1 in the cathode-crucible configuration which is made to obtain a withdrawal in the liquid state of the metal produced.

Figure 4:
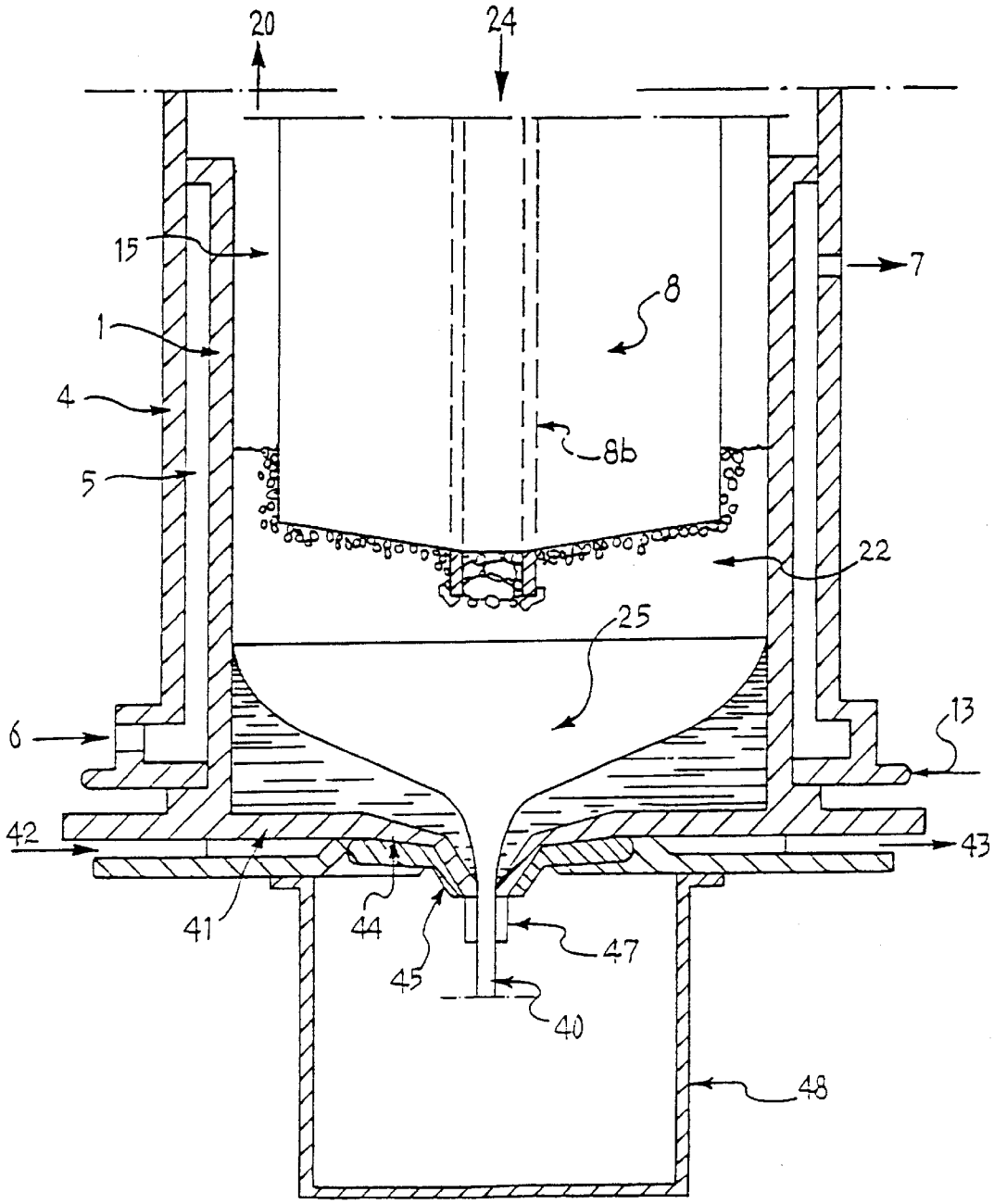
FIG. 4 is a vertical-sectional view of a crucible for carrying out the process according to the embodiment of example 3.

As illustrated in FIG. 4 the apparatus comprises of a cathode-crucible 1, consisting preferably of a copper cylinder, which is closed at its lower end by means of a cold hearth 41, provided with a radially segmented crucible 44 and a cold finger orifice 47, to allow the withdrawal of the liquid metal stream 40.

The volume of the liquid metal pool 25 is controlled by the intensity of cooling through water inlet 42 and outlet 43, counterbalanced by the intensity of heating provided by the induction coils 45 and power supply 46 to the segmented crucible 44.

The cold hearth 41 is electrically connected with the negative terminal of the power supply 13 in order to operate the electrolytic process for the cathodic reduction of the metal and its alloys.

The withdrawal of the liquid metal accumulated in the pool 25 is preferably discontinuous and a process control system, as described in example 1, is provided in order to regulate the electrolyte-anode vertical movement by means of a electrode drive assembly 27.

To activate the withdrawal of liquid metal, the electrical power to the induction coils of the cold finger orifice 47 is gradually increased in order to obtain a stream of molten metal into a lower container 48, which is air-tight sealed with the cold hearth 41, and maintained under controlled atmosphere for assuring the purity of the metal produced.

The withdrawal of liquid metal can be continuous, particularly for large cathodic surface apparata.

EXAMPLE 4

The apparatus described in the following example differs from that of example 2 in that the cathode-crucible geometrical configuration is designed to produce flat thin slabs, while the main process parameters and functioning features are similar.

Figure 5:
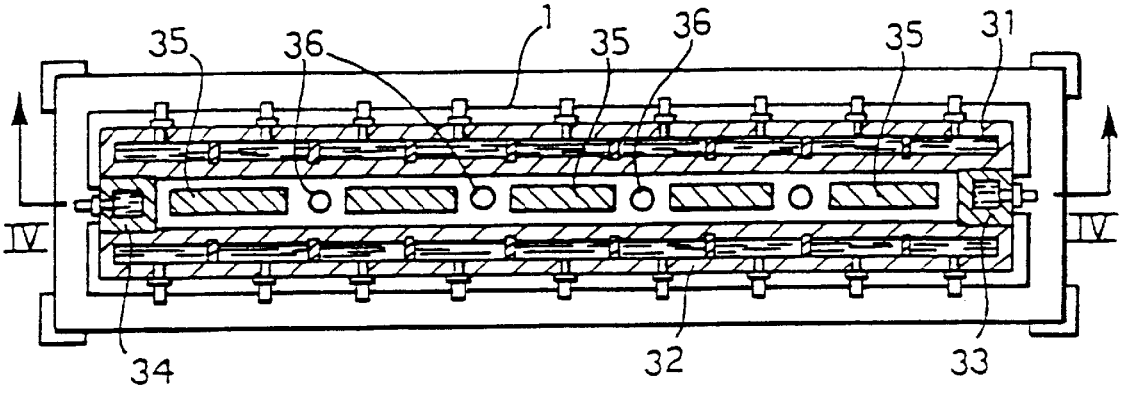
FIG. 5 is a cross-sectional view of a crucible for carrying out the process according to the embodiment of example 4.

The cathode-mold 1, shown in the cross-sectional view of FIG. 5, consists of two water-cooled copper plates 31, and 32, that are 600 to 1,300 mm wide, and are joined by lateral water-cooled copper spacers 33, and 34, that are 100 to 15 mm thick. These dimensions are not meant to restrict the applicability of the invention, but are only given as an example.

The tightness of the assembly for the containment of the liquid metal is ensured by the electrolyte layer that solidifies in the junctions between water-cooled copper members.

A plurality of graphite anodes 35 are inserted and lined up along the long side of the cathode-crucible.

A plurality of metal compounds feeders 36 are installed in such a way that each of them has its lower end immersed in the electrolyte between the anodes 35.

Figure 6:
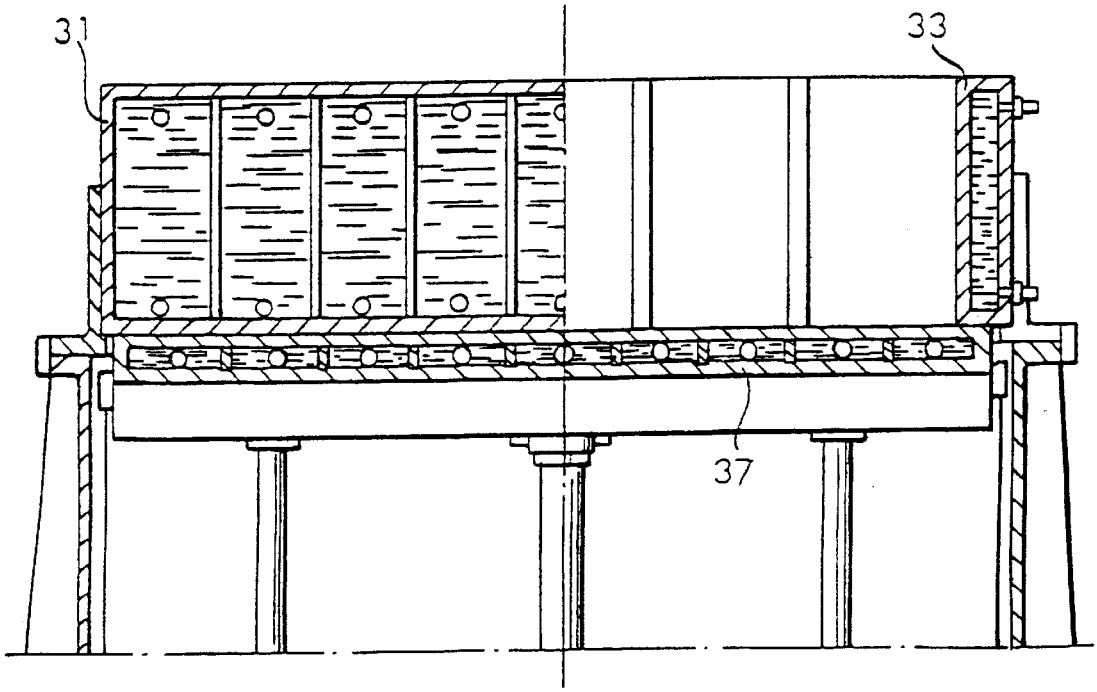
FIG. 6 is a section taken along the line IV—IV of FIG. 5.

In analogy with the apparatus of example 2, the crucible is provided with a retractable water-cooled base plate 37, illustrated in FIG. 6, which allows the gradual withdrawal of the produced metal slab, from the bottom of the mold, to a length suitable for the metallurgical rolling operations.

The amount of current and the electrolyte thickness are electronically regulated for optimum temperature equalization by a control equipment.

EXAMPLE 5

The apparatus described in the following example differs from those of examples 1 and 2 in the cathode-crucible geometrical configuration made to obtain wide flat plates, slabs and ingots, while the main process parameters and functioning features are similar.

Figure 7:
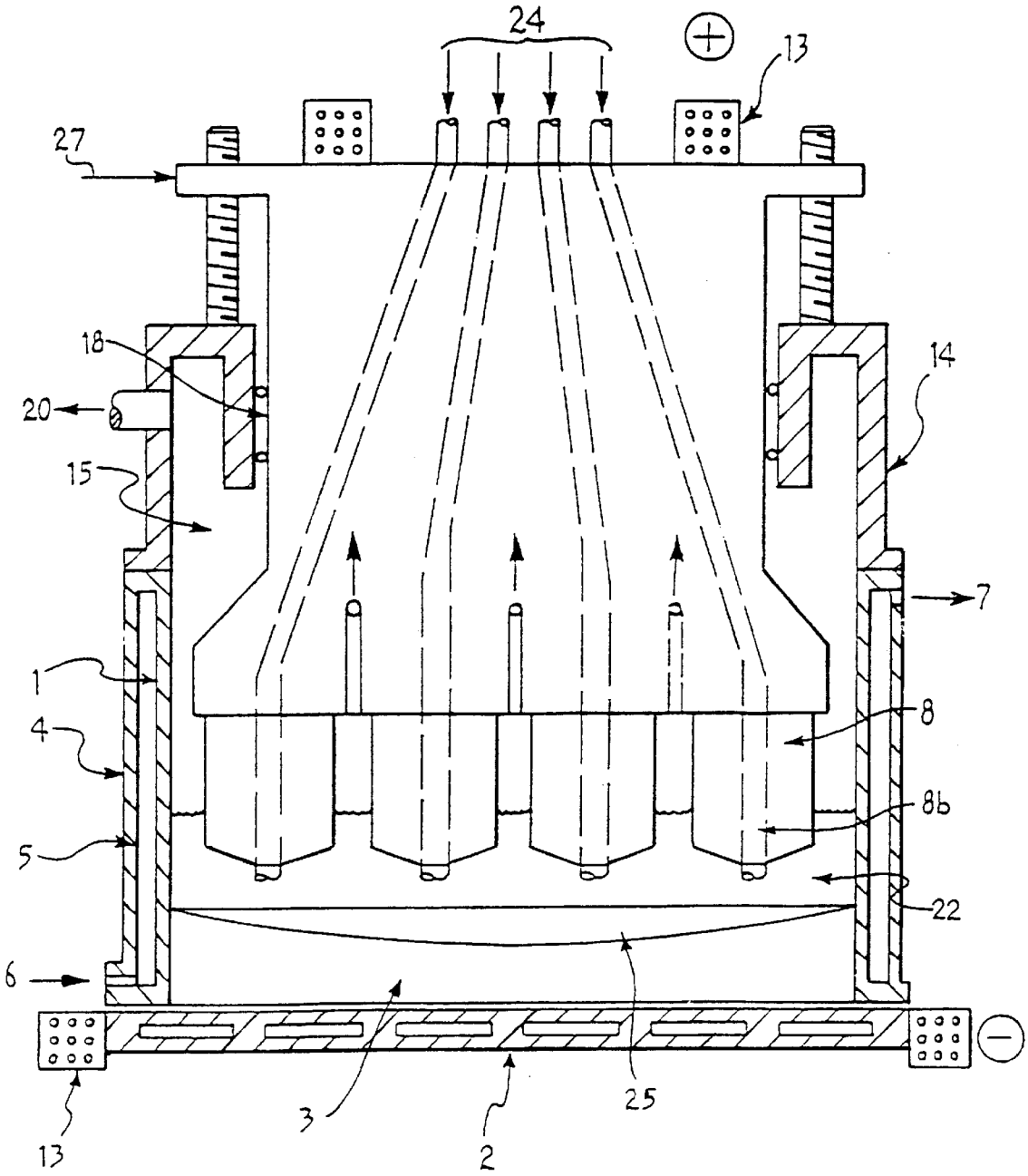
FIG. 7 is a vertical sectional view of an apparatus for carrying out the process according to the embodiment of example 5.

As illustrated in FIG. 7, the cathode consists of a rectangular water-cooled copper mold 1 with its lower end closed by a water-cooled copper plate 2.

The internal dimensions of the copper mold are for exemple 1,000 mm width and 2,000 mm length. The height is between 500 and 1,000 mm to permit the production of a titanium flat plate 250 mm thick for example.

In this embodiment of the invention, the structure comprising the mold 1, the housing vessel 4, the cover 14, a plurality of anodes 8, the anode drive assembly 27, are resting on the base plate 2 during operation of the electrolysis.

This structural assembly, in a preferred embodiment, is lifted at the end of the process to allow the harvesting of the titanium plate 3, and the bus bars connecting the positive terminal 13 of the power supply are flexible.

The anodes 8 have a geometrical configuration which is similar to those used in one type of chlorine producing electrolytic cells, and preferably have a plurality of passageways for the withdrawal of the anodic gases.

Between the anodes and preferably within the body of the anodes are the ducts 24 through which the compounds of the metals to be extracted are fed.

The anode drive assembly 27 permit the adjusting of their vertical position in order to maintain constant the electrolyte thickness, following the growth of the titanium plate during the electrolysis. A current of 200 kA will results in a production of a plate of about 1.8 ton of titanium per day for example.

The atmosphere within the inner chamber 15 is controlled by means of the vacuum tight gland 18 and of the gasket within the grove at the lower end of the mold 1.

EXAMPLE 6

The apparatus described in the following example differs from those of examples 4 and 5 in the cathode-crucible and anodes geometrical configuration made to obtain billets, while the main process parameters and functioning features are similar.

Figure 8:
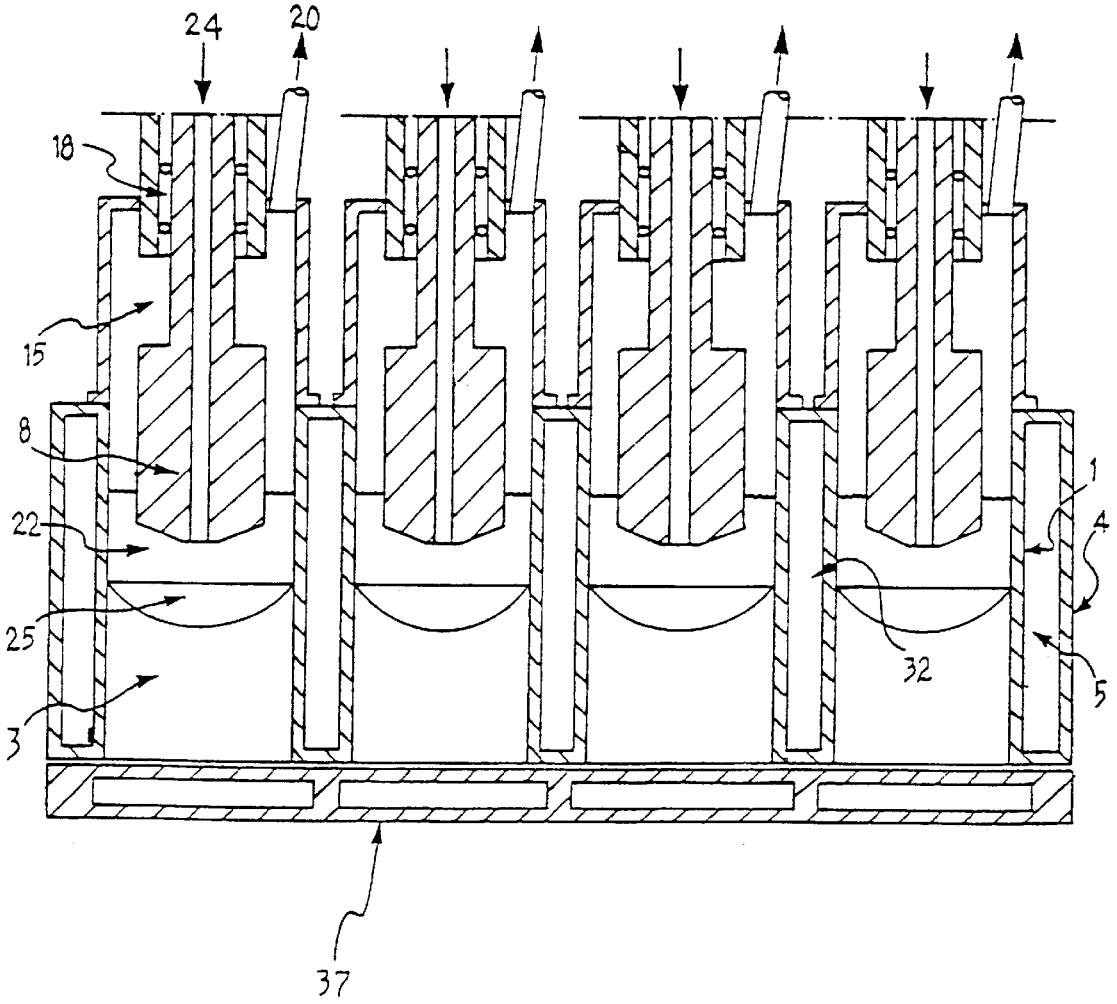
FIG. 8 is a vertical sectional view of the anodes-cathodes area of an apparatus for carrying out the process according to the embodiment of example 6.

As illustrated in FIG. 8, the cathode-crucible consists of a series of water-cooled copper partitions 32, joint by lateral water-cooled copper spacers 33, which forms a number of rectangular elongated molds, that rest on a water-cooled copper plate 37.

The height of the partitions and the width of the spacers are designed for producing billets of 140×140 mm cross section, more than 3 meters long for example.

Another difference with respect to the previous example 5 is the independent height control mechanism for each row of anodes, to ensure an even cathodic reduction of the metal in all compartments.

Since this is a preferred embodiment for the production of billets of metal alloys that go to the manufacture of long products, the additions of alloying material is performed in the liquid-gaseous state through ducts 24, and in the solid state by means of feeders 36, 21, as indicated in the previous examples.

EXAMPLE 7

The apparatus described in the following example differs from those of examples 1 to 6 in the electrolyte composition, which is made to use the beneficial effects of the combined presence of monovalent alkali metals with divalent alkaline earth metals.

The apparatus and the main process parameters are similar and apply to all FIGS. from 1 to 8.

One of the possible electrolyte compositions consist preferably of $CaF_2$ with for example 9% KF, and amounts of $CaCl_2$ and KCl, and Ca° and K°, which depend on the feed rate of $TiCl_4$ relative to the total current; 3%Ca° and 3%K° for example.

The lower electrical resistivity of the electrolyte compositions taught in this example, permits the operations of the cell with a thicker bath, at higher current densities, while keeping the system at the desired temperature.

With this mode of operation, near 100% yield for $TiCl_4$ reduction reaction is obtained, together with very high cell productivity. KCl and $CaCl_2$ allows the continuation of $Cl_2$ gas anodic evolution for the case of $TiCl_4$ injection discontinuities.

What we claim is:

1. A process for the electrolytic production of a metal or an alloy comprising:

(a) providing an electrowinning apparatus which comprises a cathode-crucible with a solid metal skull covered by a liquid electrolyte containing the metal compound to be produced or alloy materials and having a density lower than the metal and the alloy, and at least one non-consumable anode at a distance from the cathode and partially immersed in the electrolyte, wherein the metal compound is selected from the group consisting of metal fluorides, metal chlorides, metal bromides and metal iodides; and (b) supplying a direct current through the electrolyte to the anode in order to cause cathodic reduction of the metal in a liquid state to act as a liquid cathode and generate heat sufficient to maintain the electrolyte molten.

2. The process of claim 1 further comprising adding electrolyte components and at least one metal compound or alloy materials to the electrolyte.

3. The process of claim 2, wherein the metal compound or alloy materials are added to the electrolyte by feeding through ducts made inside the anode.

4. The process of claim 2, wherein the metal compound or alloy materials are added to the electrolyte by feeding through an electrically insulated tube made of chemically inert material.

5. The process of claim 2, wherein the production of an alloy with specific chemical composition is achieved by adding metal compounds and alloy materials in amounts corresponding to the specific chemical composition of the alloy.

6. The process of claim 1, wherein a means for adjusting the distance between the anode and the cathode is used to maintain constant electrochemical parameters.

7. The process of claim 1, wherein the metal is selected from the group consisting of titanium, zirconium, thorium, vanadium, chromium, nickel, cobalt, yttrium, beryllium, silicon, rare earths and mishmetal.

8. The process of claim 7, wherein the metal is titanium.

9. The process of claim 8, wherein the electrolyte comprises a mixture of calcium fluoride, calcium chloride and calcium metal.

10. The process of claim 1, wherein the alloy comprises metals selected from the group consisting of reactives, refractories, transitions, lanthanides and actinides.

11. The process of claim 1, wherein the electrolyte comprises a mixture of an alkali metal and an alkaline earth metal.

12. The process of claim 1, wherein the cathode-crucible is a copper crucible.

13. The process of claim 1, wherein the crucible is sufficiently cooled to cause the solidification of a protecting layer of the electrolyte on the crucible.

14. The process of claim 1, wherein vapors are generated from the electrolyte and gases are generated at the anode and both vapors and gases are collected in an air-tight vessel.

15. The process of claim 14, wherein the air-tight vessel is cooled to condense the vapors thereby protecting the vessel from the gases.

16. The process of claim 14, wherein the gases generated at the anode are conveyed to the air-tight vessel through ducts inside the anode.

17. The process of claim 14, wherein the anode has a lower end shaped and machined to enhance evolution of the gases generated at said anode.

18. The process of claim 1, wherein liquid metal or alloy is produced and at least a portion thereof turns into a solidified state.

19. The process of claim 18, wherein the solidified metal or alloy produced is continuously collected.

20. The process of claim 1, wherein the liquid metal produced is collected by means of a cold finger induction orifice.

21. The process of claim 1, wherein the produced metal or alloy is used to make plates, slabs, blooms and a billet of metal or alloy.

22. The method of claim 1, wherein the current is supplied by means of cooled anodic busbars.

23. The method of claim 1, wherein the electrolyte comprises a mixture of monovalent alkali metals and divalent alkaline earth metals.

24. The method of claim 1 wherein the electrolyte comprises a mixture of $Ca^{\circ}$ and $K^{\circ}$ or $Ca^{\circ}$ and $Mg^{\circ}$.

* * * * *